US005806355A

United States Patent [19]

Lanigan et al.

[11] Patent Number: 5,806,355

[45] Date of Patent: Sep. 15, 1998

[54] UNIVERSAL ADAPTER FOR A SECURITY SYSTEM

[76] Inventors: William P. Lanigan, 16946 Blue Heron Dr., Orland Park, Ill. 60462; Peter W. Mirabella, 7647 Starling Dr., Schererville, Ind. 46375; Gerald F. Chalko, Jr., 2306 Martha St., Unit 102, Highland, Ind. 46322

[21] Appl. No.: 615,361

[22] Filed: Mar. 14, 1996

[51] Int. Cl.[6] ..... E05B 65/12

[52] U.S. Cl. ..... 70/257; 292/201; 292/DIG. 53; 292/DIG. 60; 292/DIG. 32; 70/461; 70/451; 248/282.1

[58] Field of Search ..... 292/DIG. 53, DIG. 55, 292/DIG. 54, DIG. 60, DIG. 32, DIG. 36, 201; 70/461, 451, 257, 256; 248/282.1

[56] References Cited

U.S. PATENT DOCUMENTS

| | | | |
|---|---|---|---|
| 2,325,225 | 7/1943 | Burke . | |
| 2,731,822 | 1/1956 | Bargman | 292/DIG. 55 |
| 4,223,943 | 9/1980 | Van Hulle et al. | 292/DIG. 55 |
| 4,261,155 | 4/1981 | Gilb | 248/282.1 |
| 4,453,161 | 6/1984 | Lemelson | 340/825.31 |
| 4,926,664 | 5/1990 | Gartner et al. | 70/278 |
| 5,000,497 | 3/1991 | Geringer et al. | 292/DIG. 55 |
| 5,058,939 | 10/1991 | Miilu | 292/DIG. 49 |
| 5,076,625 | 12/1991 | Oxley | 292/341.16 |
| 5,339,662 | 8/1994 | Goldman | 70/278 |

*Primary Examiner*—Darnell M. Boucher

[57] ABSTRACT

A universal adapter (300) for a security system, having: a back plate (302) having a left portion (304) and a right portion (306); and positioning adapter plates (308,310) extending substantially outwardly from the left and right portions (304,306) of the back plate (302), the positioning adapter plates (308,310) having an adjustment structure, such as a first pair of ports (314) spaced in proximity to the back plate (302) and a second pair of ports (316) spaced away from the back plate (302) , adapted to adjustably receive a lock assembly of a security system in a first position proximate to the back plate and a second position away from the back plate. Also, the adapter can have a clamping structure (350) for holding a locking structure with respect to an inside of a cargo loading door.

19 Claims, 13 Drawing Sheets

332
322

324

332
326

322

Fig 25
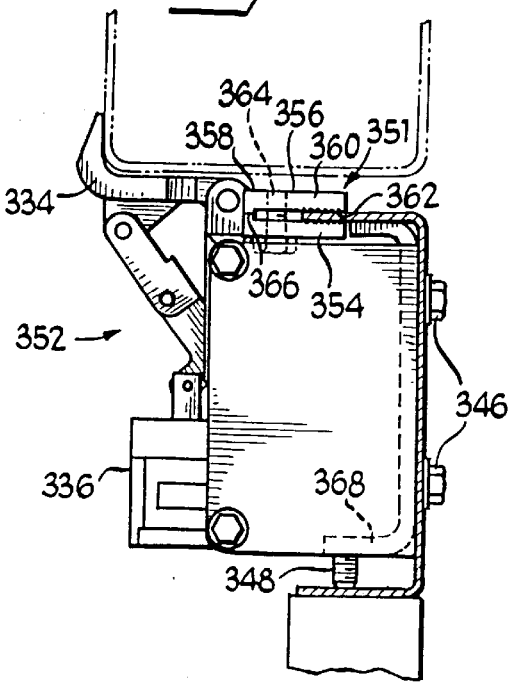
Fig 26
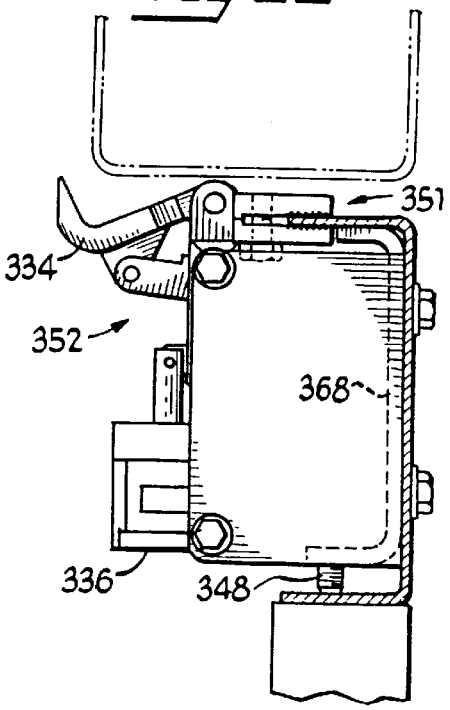
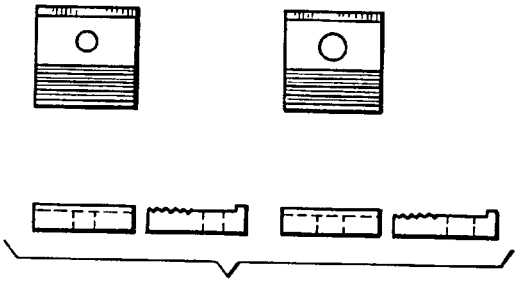
Fig 27
Fig 28
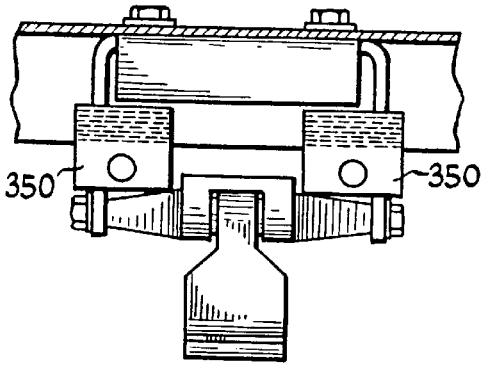
Fig 29
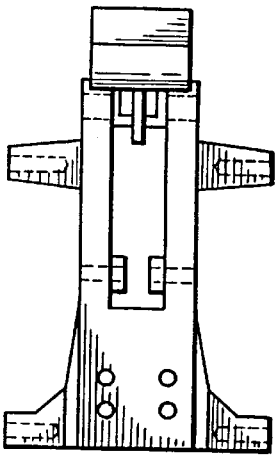

UNIVERSAL ADAPTER FOR A SECURITY SYSTEM

FIELD OF THE INVENTION

This invention relates to security systems, and particularly to retrofitable and factory installable universal adapter for a security system.

BACKGROUND OF THE INVENTION

FIG. 1 shows the back of a conventional semi-trailer or cargo container 10 or other similar enclosed body, preferably in the form of an International Standards Organization (ISO) container, domestic container or semi-trailer, having a pair of doors 12 and 14, hinged along their outer edges at 16 and 18 to opposite vertical sides 20 and 22 of door frame or opening 24. Thus, doors 12 and 14 are mounted for relative rotation in opposite directions around sides 20 and 22 between a closed position as shown in FIG. 1, and an open position. When either or both doors 12 and 14 are open, ready access is provided through door opening 24 to load or unload cargo into or out of the trailer or container 10.

When doors 12 and 14 are closed, an overlapping tab (door retainer) which can be internal or external to the doors, can be used. In use, door 12 is closed first and thereafter door 14 is closed to overlap and hold door 12 closed. Typically, an overlapping tab (door retainer) which is external to the doors can be used to overlap door 12. Subsequently, door 14 is typically opened first before door 12 can be rotated to the open position.

Carried by each door is a conventional closure assembly of any number of axially rotatable rods 30, suitably journaled in upper and lower brackets 32 and 34 on the door and provided with a handle 36. The upper and lower ends of the rod 30 engage with cam members 38 and 40 and bring the door to a fully closed position as the handle 36 and attached rod 30 are manually rotated to the position in FIG. 1. When in this position, a padlock or the like can be used to keep handle 36 and attached rod 30 in the closed position, as shown.

Accordingly, the manually operable closure means (rod 30, brackets 32 and 34, handles 36 and cam members 38 and 40) are located on the exterior of the container 10 where they are readily accessible by authorized and unauthorized workers and drivers, as well as would be thieves intent on stealing products and goods which may be contained in the semi-trailers and similar bodies and like enclosures. Previously, the security for these trailers, ISO containers, domestic containers and the like has been quite poor, usually consisting of a padlock and/or seal having an exposed link which can be cut by bolt cutters or equivalent tools. Thus, semi-trailers, containers and trucks left unattended for any length of time, as over night in truck terminals, intermodal terminals and freight yards, on shipping docks and piggy-back railroad cars, or at industrial or commercial loading areas (and during transit), are vulnerable to thievery and pilferage.

The problem of vulnerability of externally located closure means is minimized by the present invention, through the employment of a retrofitable or factory installed security system adapted to be located within a container, where it is not accessible to a would be thief or opportunist.

There is a need for a need for a universal adapter for installing a security system adapted to be located within a container, where it is not accessible to a would be thief or opportunist.

There is an ever demanding requirement for improved security systems for cargo loading doors and enclosures for the worldwide transportation industry.

BRIEF DESCRIPTION OF THE DRAWINGS

FIGS. 25 and 26 are elevated partial side views of the security system with an alternate embodiment of the universal adapter having gripping structure adapted to secure a locking assembly with respect to a door, the locking assembly has a latch shown in a locked and unlocked position, respectively, in accordance with the present invention;

FIG. 27 is a partial view of the gripping structure showing an embodiment of the individual plates in FIGS. 25 and 26, in accordance with the present invention;

FIG. 28 is a top view of the universal adapter showing dual gripping structures adapted to secure a locking assembly with respect to a door, the locking assembly has a latch, in accordance with the present invention;

FIG. 29 is a partial view of the locking assembly adapted to be used in connection with the adapter in FIGS. 25–28, in accordance with the present invention:

DETAILED DESCRIPTION OF THE PREFERRED EMBODIMENT

Referring to the figures, a retrofitable or factory installable security system 50 is shown. The security system 50 is particularly adapted for cargo loading doors for cargo containers, ISO containers, domestic containers, truck trailers and the like (hereafter referred to as "containers"). Placement of system 50 may vary from the position (top right) shown in FIG. 1 and the other figures, the placement shown in the figures being a preferred placement to minimize the possibility of breakage during loading and unloading of cargo.

Figure 5:
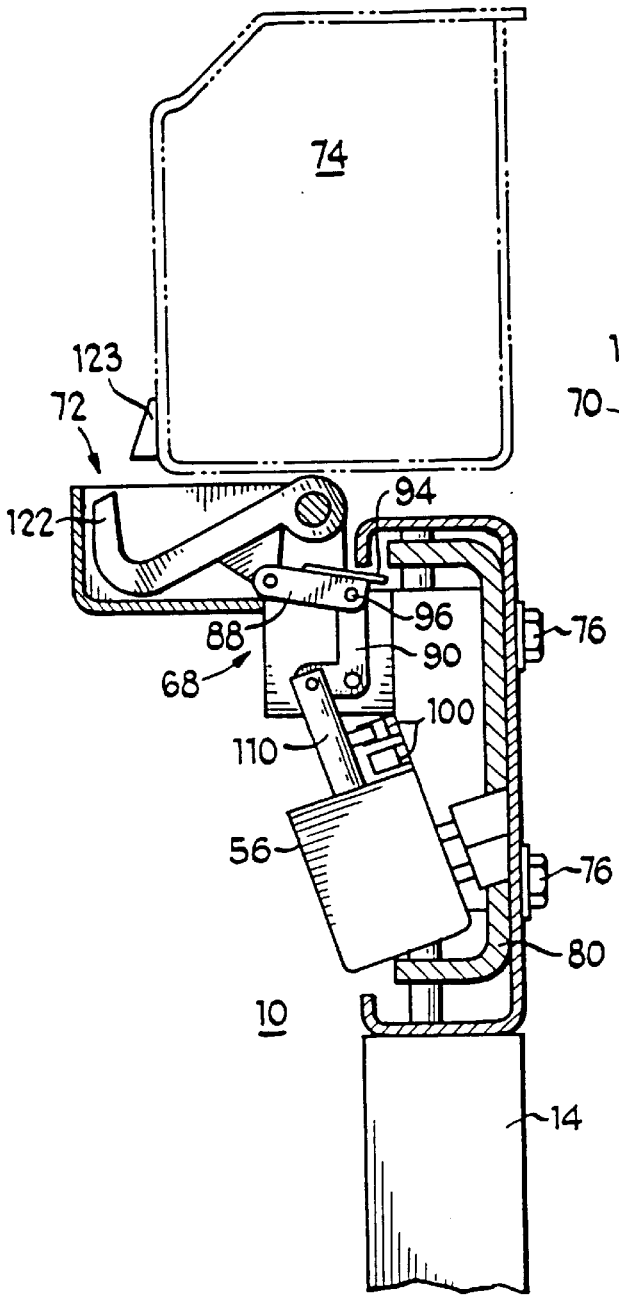
FIG. 5 is a cut away view taken along the lines 5—5 in FIG. 2, of a portion of the security system showing the latching device in a relaxed position (or a portion of a lock assembly in an unlocked position), in accordance with the present invention.
Figure 6:
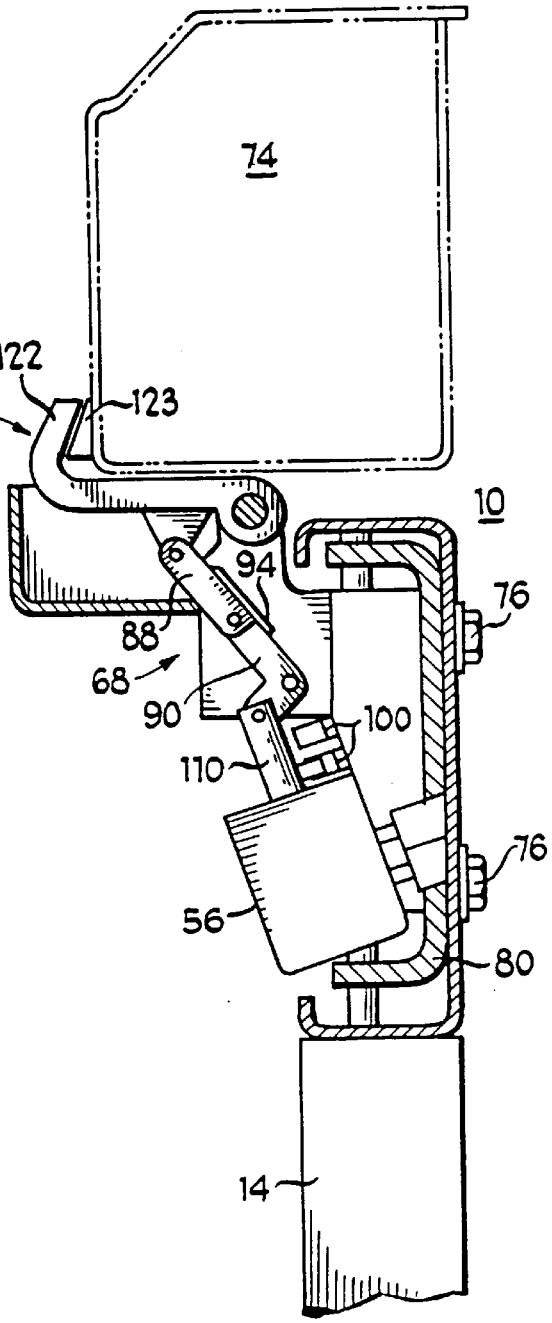
FIG. 6 is a cut away view taken along the lines 5—5 in FIG. 2, of a portion of the security system showing the latching device in a raised position (or a portion of the lock assembly in a locked position), in accordance with the present invention.
Figure 8:
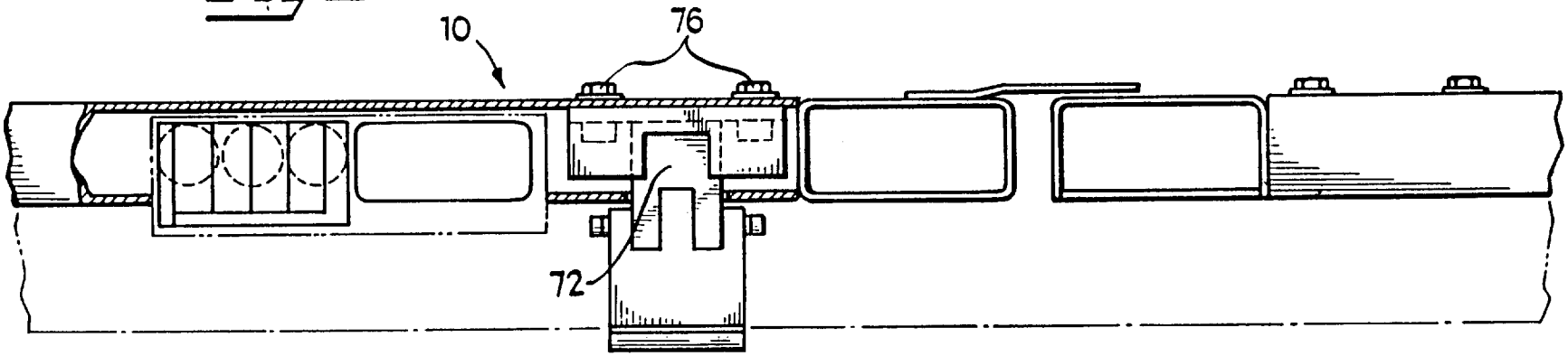
FIG. 8 is a top view of a portion of the security system in FIGS. 1–7, in accordance with the present invention.

The security system 50 in its simplest form, comprises: a remote transmitter 52 for transmitting a radio signal; a receiver 54 for receiving the radio signal from the remote transmitter 52; an electro-mechanical actuator 56 coupled to the receiver 54 for moving a latching device 66 between a locked position 60 and an unlocked position 62; and a lock assembly 58 including a housing 64 for holding the electro-mechanical actuator 56, a latching device 66 pivotably connected to the housing 64, and a linkage mechanism 68 coupling the electro-mechanical actuator 56 and the latching device 66 for moving the latching device 66 to and from a raised position 70 to a relaxed position 72, whereby the latching device 66 is movable between the locked position 60, as shown in FIG. 6, and unlocked position 62, in FIG. 5, respectively.

In one embodiment, the remote transmitter and receiver can each be transceivers, for an improved intelligent communication system. The system can provide, but is not limited to, for storage, identification, memory and interrogation of the system 50. For example, this feature could provide a history of all door openings, closings and tamperings of the system 50.

This system is configured to be tamper resistant because of it's placement which is preferably internal to a container. In addition, system 50 has been designed in a preferred embodiment to have a low profile to minimize intrusion into the valuable cargo space of the container. In one embodiment, only one latching mechanism is necessary to lock two doors when utilized with a door retainer or the like, providing simplicity of design. As should be understood, other embodiments can include a plurality of latching mechanisms.

Figure 1:
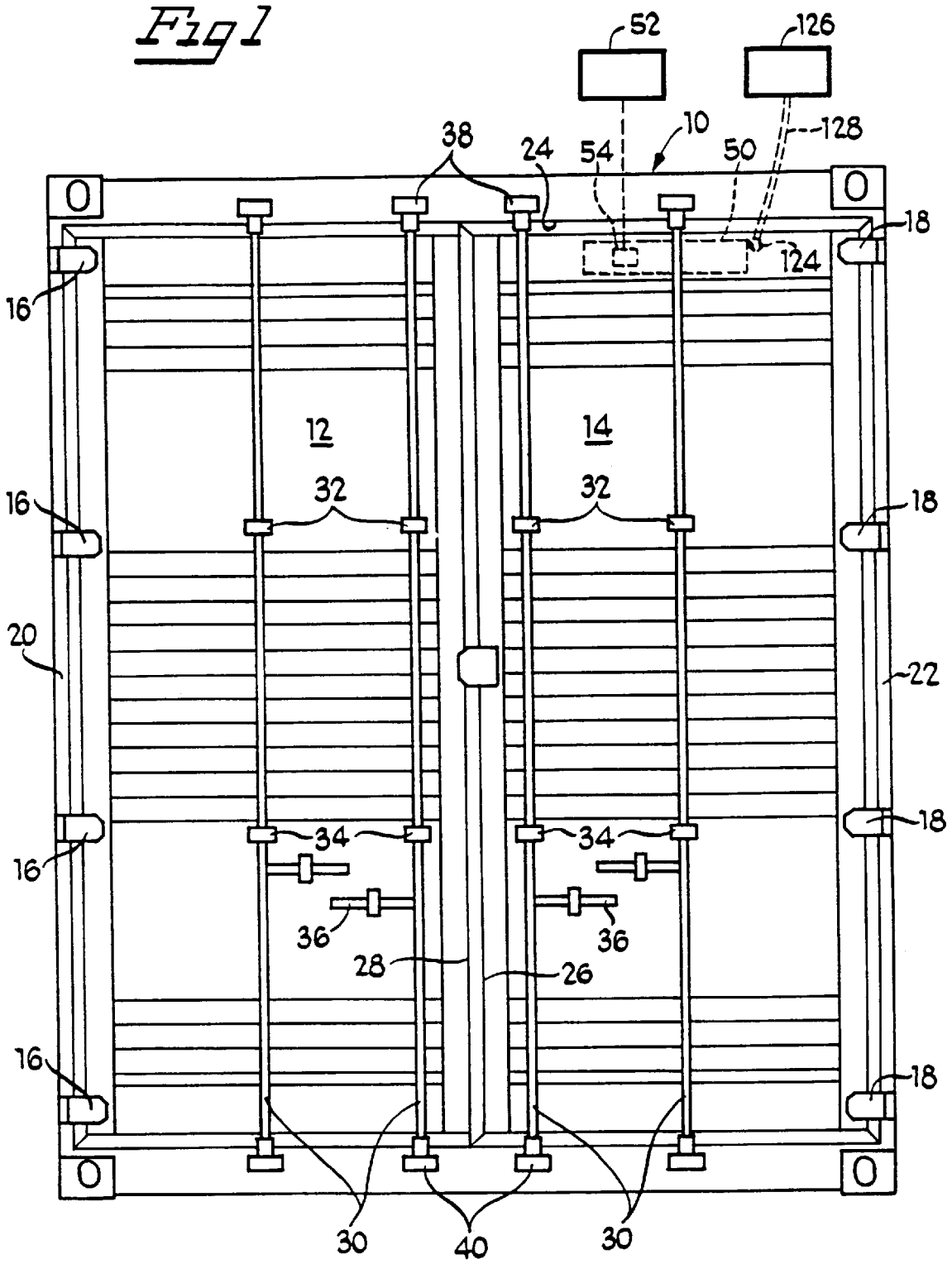
FIG. 1 is a rear view of an ISO container or other similar enclosed body, showing in dashed line a typical placement of part of a security system for cargo loading doors, in accordance with the present invention.

In a preferred embodiment, the housing 64 is adapted to be connected to an inside of a cargo loading door, such as positioned at the top right corner, as shown in dashed line as item 50 in FIG. 1. This remote placement is out of the way so as not to interfere with the loading and unloading operation. Thus, this strategic position provides a substantially tamper proof security system, preferably with internal placement of system 50, so as to be visually hidden from an opportunist or thief.

Also in a preferred embodiment, the latching device 66 is particularly adapted to latch to a header 74 of an ISO container 10 when the latching device 66 is in the locked position 60 and unlatched from the header 74 when the latching device 66 is moved to the unlocked position 62, as shown in FIGS. 5 and 6. By utilizing a header of a container to lock the doors, a retrofittable or factory installable system 50 is easily installed, thus minimizing the need for cutting, drilling or welding during installation.

Figure 4:
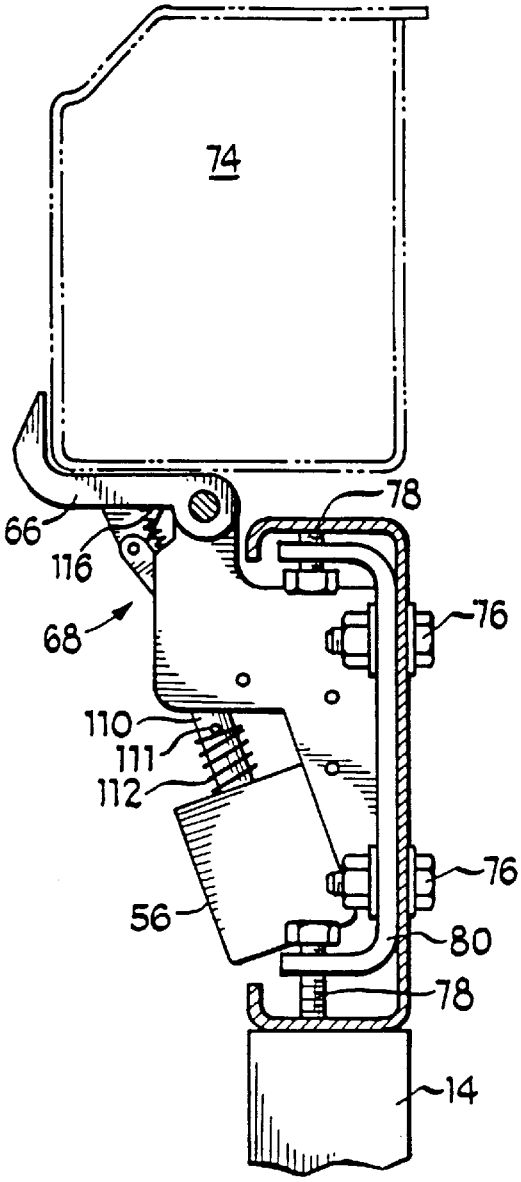
FIG. 4 is a side view taken along the lines 4—4 in FIG. 2 without a cover, of a portion of the security system, in accordance with the present invention.

In one embodiment as shown in FIG. 4, the housing 64 can include primary connecting devices 76, or fastening means such as bolts and nuts extending through the door and attach a portion of the system 50 to the inside door 14. Also, secondary connecting devices or supplemental fastening means such as set screws or bolts applying outward axial pressure can be used, to define a secondary securement mechanism between the housing 64 and the cargo loading door 14. The primary connecting devices 76 provide accuracy and consistency in placement, location and alignment of a portion of the system 50. Further, the secondary connecting devices 78, in the event of removal of the primary devices 76 (during a break in), continue to secure and maintain the system 50 at the desired position.

Figure 9:
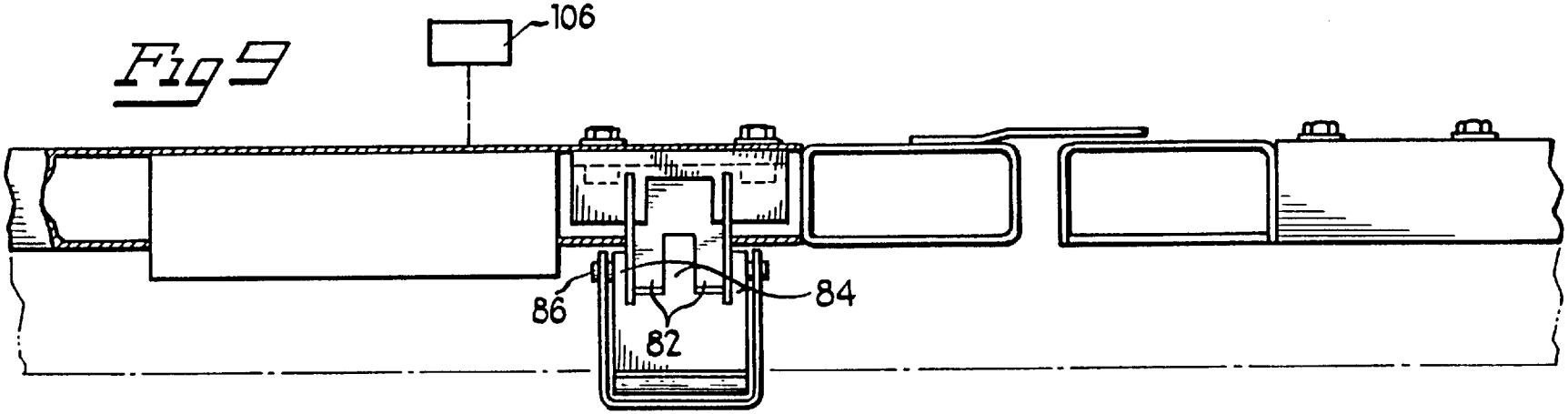
FIG. 9 is a top view of a portion of the security system in FIGS. 1–7 with an optional external antenna, in accordance with the present invention.

As best shown in FIG. 9, the housing 64 can further include a back plate 80 with a plurality of outwardly extending anchor members 82, which are adapted to be coupled with a plurality of hinge members 84 of the latching device 66, via a pivot pin 86. Advantageously, this structure allows the lock assembly 58 to easily move from the locked position 60 to the unlocked position 62. This structure also allows for variations in door and frame geometries.

As illustrated in FIGS. 5 and 6, the linkage mechanism 68 includes an elongated distal section 88 and an L-shaped proximal section 90, the distal section 88 is coupled to the latching device 66 and a short leg 92 of the L-shaped proximal section 90 is couplable with the electro-mechanical actuator 56. This structure provides the advantages of converting minimal linear motion to angular motion required to move the latching device 66 from the locked to the unlocked position and vice versa. Advantageously, it also simulates a rigid link thus holding the latch 66 in its locked position and diverting any forces from the electro-mechanical actuator 56 to the housing 64, for improved strength and integrity. Additionally, in this position the system 50 is self locking and requires essentially no battery power, thus minimizing battery drain.

In one embodiment, the elongated distal section 88 includes a stop tab 94. The stop tab 94 properly aligns the linkage mechanism 68 beyond center with respect to the proximal section 90 to simulate a rigid link securing the latching device 66 in its locked position 60, in FIG. 6.

The L-shaped proximal section 90 and the elongated distal section 88 are couplable with a pivot pin 96. The pivot pin 96 allows rotation and transfer of motion through the distal section 88 to the latching device 66.

As shown in the figures, the L-shaped proximal section 90 is pivotably connected to the anchor members 82 of the housing via a stationary pivot pin 98. The pivot pin 98 is significant in the conversion of linear to angular motion, and maintaining a simulated rigid link. It is connected to a middle portion of the anchor members 82 of the housing 64. This allows a minimal amount of displacement from the electro-mechanical actuator 56 to move and rotate the latching device 66.

As best shown in FIGS. 5 and 6, the electro-mechanical actuator 56 can include one or more sensors 100 for sensing whether the lock assembly 58 is in the locked or unlocked position 60 or 62. In the event that the latching device 66 is not in a position after a given command, from the remote transmitter 52, the sensor(s) 100 can provide a signal that will allow re-execution automatically after a predetermined time, for example. In addition, this structure can provide feedback in order to give positioning data as to internal location of the latching device 66.

In one embodiment, the security system 50 includes an electronic control 102 or interface structure, coupled to the receiver 54 and the electro-mechanical actuator 56. This structure interprets the transmitted information to suitably execute an open or close command, for example. Advantageously, this structure can receive information from the remote transmitter 52 without the necessity of an external power source other than the batteries or power supplies 108 shown in the figures. Also, this structure 102, like most of the other components of the security system 50, has a narrow width or profile so as to minimally intrude into the valuable cargo space.

Figure 2:
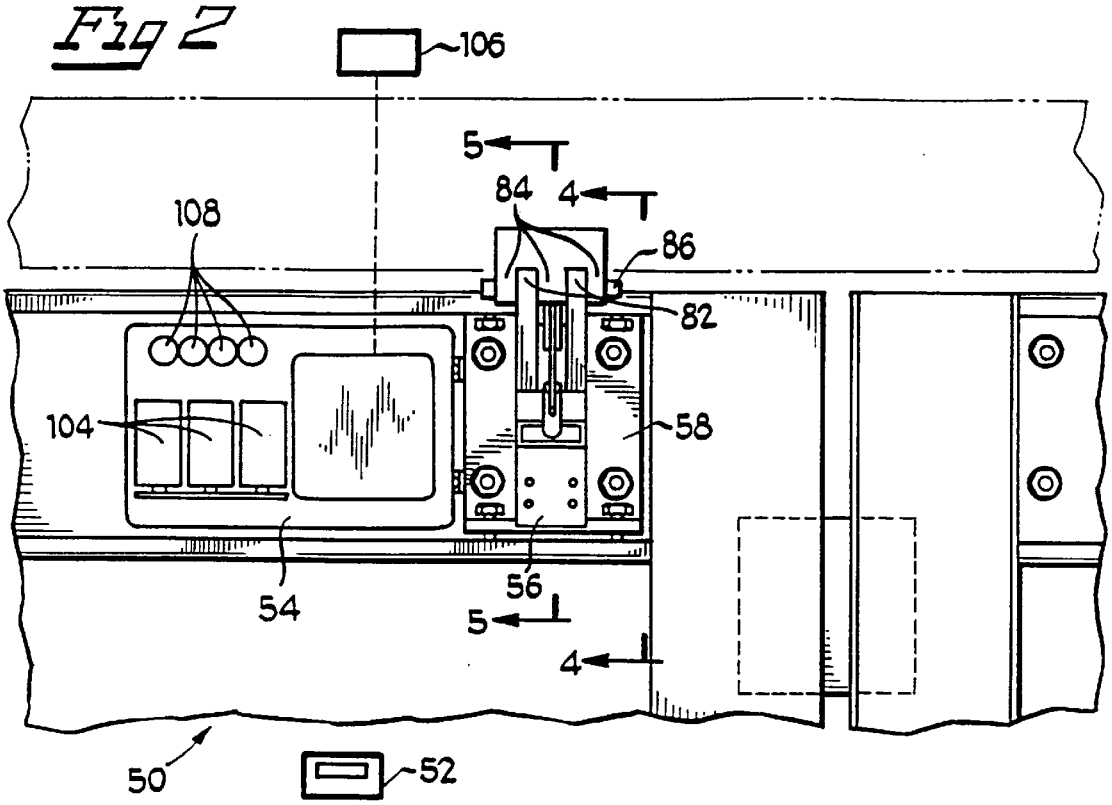
FIG. 2 is an inside view of part of the security system, without a cover (to show the placement of some of the various components) and a remote transmitter, in accordance with the present invention.
Figure 3:
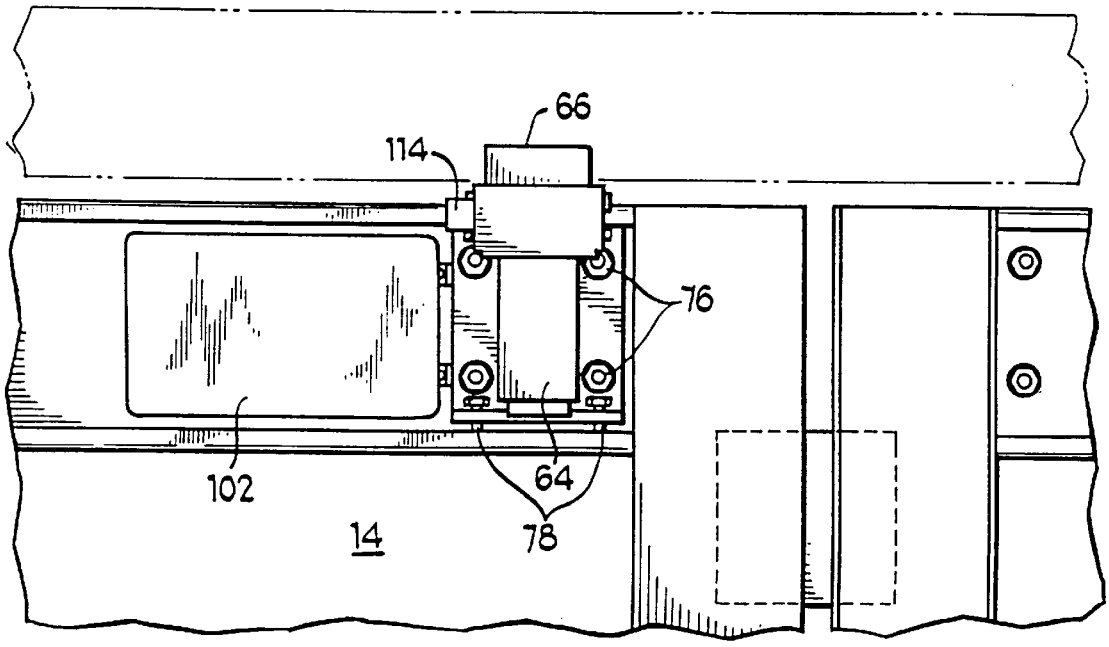
FIG. 3 is an inside view of part of the security system, with a cover which protects many of the components, in accordance with the present invention.

As shown in FIG. 2, the security system 50 includes an electronic control or interface structure 102 coupled to the receiver 54 and the electro-mechanical actuator 56, capacitor(s) 104, an antenna 106 and power supplies 108. The capacitors 104 suitably build-up and store energy to rapidly release an electrical charge, to actuate the electro-mechanical actuator 56, to appropriately move a plunger 110. This provides an efficient use of the energy supplied by the power supply 108, preferably in the form of batteries. The antenna can vary widely depending on the application, and can be of a conventional type or patch type, for example. In a preferred embodiment, the antenna is placed internal to a container to keep it hidden and minimize the possibility of damage, and is operably coupled to the system 50, for suitable reception of a signal. In another embodiment, the antenna could be external, if desired.

In a preferred embodiment, a sensor, such as but not limited to, a proximity sensor 114 can be utilized to allow the latch to be actuated only when a door 14 is in proximity to a metallic material, such as a header 74. Thus, this feature can help to minimize damage to the latching device 66, when closing the door with the latching device 66 in a locked position. The sensor 114 is suitably connected to the other components of the security system 50, for example 54, 56, and 64 and is preferably physically connected to and in proximity of the latch 66, for accurate sensing.

In FIG. 4, the electro-mechanical actuator 56 includes a plunger 110, a snap ring 111 and a spring 112. The spring provides an outward force to bias the plunger 110 to an extended position when the plunger 110 is released.

A second spring 116 is shown in FIG. 4, and can be used to help push (bias) the latch 66 to the locked position if desired. The spring can help to contribute to minimizing current drain and facilitating movement to the locked position. It is strategically and physically located between the latching device 66 and anchor member 82 of the housing 64 so as not to require more space, thus providing minimal space requirements for the system 50.

Figure 7:
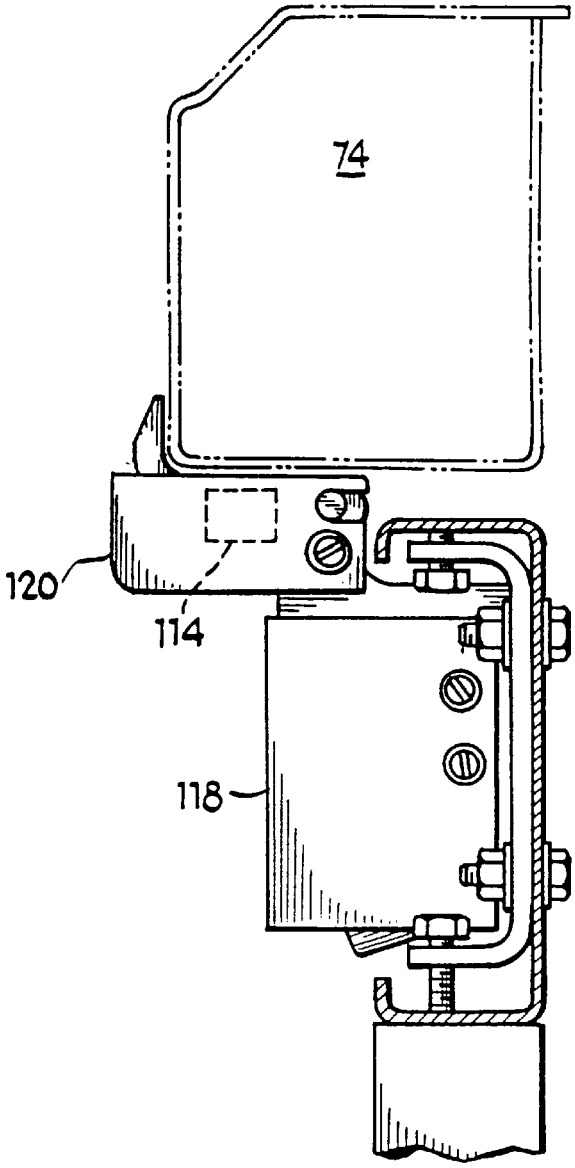
FIG. 7 is a side view taken along the lines 4—4 in FIG. 2 with a solenoid cover and latch guard for a portion of the security system, in accordance with the present invention.

As best shown in FIG. 7, the housing 64 can include a solenoid cover 118 and latch guard 120 for protecting the latching device (and linkage) from load shifts.

In use, the electro-mechanical actuator 56 is in a form of a solenoid, and can be suitably actuated, to convert electrical energy to magnetic energy, which in turn can be converted to a mechanical energy. Thus, this structure can generate a pulling action to provide the locked position 60 in FIG. 6. Continuing, the plunger 110 continues until it bottoms out internally against a permanent magnet within the actuator 56, thus, positioning the linkage to provide a simulated rigid link. Subsequently, when the actuator 56 is next actuated via the remote transmitter 52, the solenoid by use of the windings, releases the plunger 110 to allow it to move away from the magnet (to move to an extended, solenoid plunger 110 position) extending outwardly, defining an unlocked position as shown in FIG. 5.

As shown in FIGS. 5 and 6, the latching device includes an L-shaped latch 122 with a predetermined angle adapted to be coupled with a complementarily configured block 123 connected to a header 74 of a container, to provide a self-engaging connection.

In one embodiment, a port 124 is included in the door 12, to provide access to a electronic key 126 having an external probe means 128, for connection to system 50, to provide one or more of: external power to the system 50; a battery charger; open and close signals to the system 50; interrogate the system 50 and the like.

Referring to FIGS. 10 through 16, an alternate retrofitable or factory installable security system 150 is shown. The security system 150 is particularly adapted for cargo loading doors for domestic containers and trailers and the like . Placement of system 150 may vary from the position (top right) shown in FIG. 1 and the other figures, the placement shown in the figures being a preferred placement to minimize the possibility of breakage during loading and unloading of cargo.

The security system 150 in its simplest form, comprises: a remote transmitter 152 for transmitting a radio signal; a receiver 154 for receiving the radio signal from the remote transmitter 152; an electro-mechanical actuator 156 coupled to the receiver 154 for moving a pin device 166 between a locked position 160 and an unlocked position 162; and a lock assembly 158 for holding the electro-mechanical actuator 156, a pin device 166 and a linkage mechanism 168 coupling the electro-mechanical actuator 156 and the pin device 166 for moving the pin device 166 to and from a locked position 160 to an unlocked position 162.

In one embodiment, the remote transmitter 152 and receiver 154 can each be transceivers, for an improved intelligent communication system. The system 150 can provide for storage, identification, memory and interrogation of the system 150, for example. This feature could provide a history of all door openings, closings and tamperings of the system 150.

This system is configured to be tamper resistant because of it's placement which is preferably internal to a container. In addition, system 150 has been designed in a preferred embodiment to have a low profile to minimize intrusion into the valuable cargo space of the container. In one embodiment, only one pin device 166 is necessary to lock two doors when utilized with a door retainer or the like, providing simplicity of design. As should be understood, other embodiments can include a plurality of pin devices.

In a preferred embodiment, the lock assembly 158 is adapted to being connected to an inside of a cargo loading door, such as positioned at the top right corner, as shown in dashed line as item 50 in FIG. 1. This remote placement is out of the way so as not to interfere with the loading and unloading operation. Thus, this strategic position provides a substantially tamper proof security system, preferably with internal placement of system 150, so as to be visually hidden from an opportunist or thief.

Figure 16:
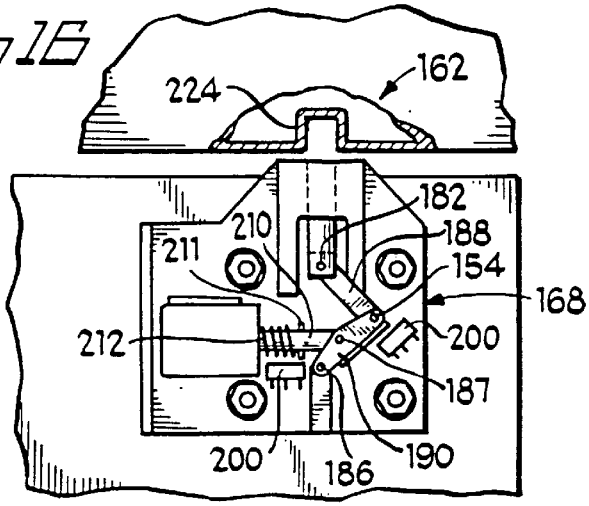
FIG. 16 is a partial inside view of a selected portion of the security system in FIG. 10, without a cover (to show the placement of some of the various components), in accordance with the present invention.

Also in a preferred embodiment, the pin device 166 is particularly adapted to lock and interconnect to a header 174 of a container 10 when the pin device 166 is in the locked position 160 and unlocked 162 from the header 174 when the pin device 166 is retracted, as shown as item 162 in FIG. 16. By utilizing a header of a container to lock the doors, a retrofittable or factory installable system 150 can be installed, thus minimizing the need for cutting, drilling or welding during installation.

The lock assembly is shown with primary connecting devices 176, or fastening means such as bolts and nuts extending through the door and attach a portion of the system 150 to the inside door 14.

Figure 13:
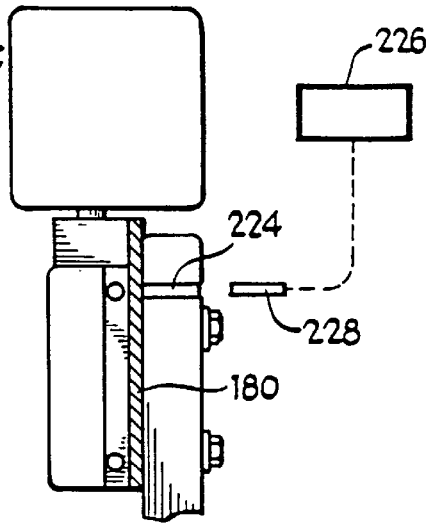
FIG. 13 is a cut away view taken along the lines 13—13 in FIG. 11, of a portion of the security system of FIG. 10, showing the pin structure in a raised position (or a portion of the lock assembly in a locked position), in accordance with the present invention.
Figure 14:
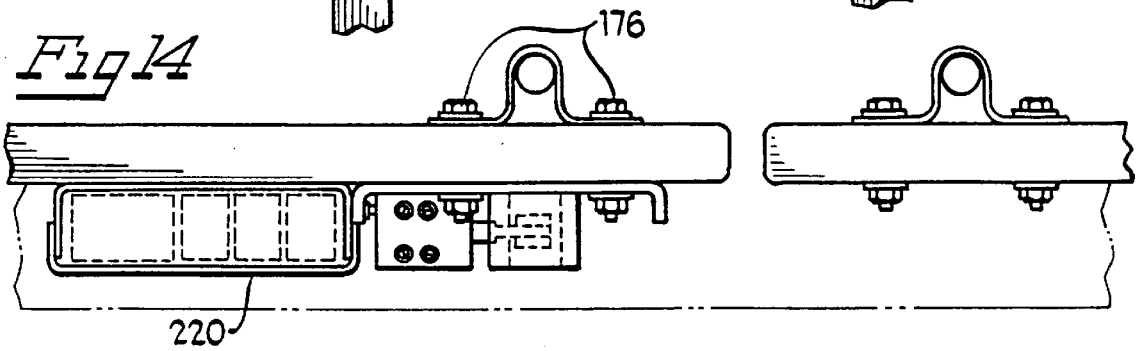
FIGS. 14 and 15 show top views of a portion of the security system in FIGS. 10, without and with a cover, respectively, in accordance with the present invention.
Figure 15:
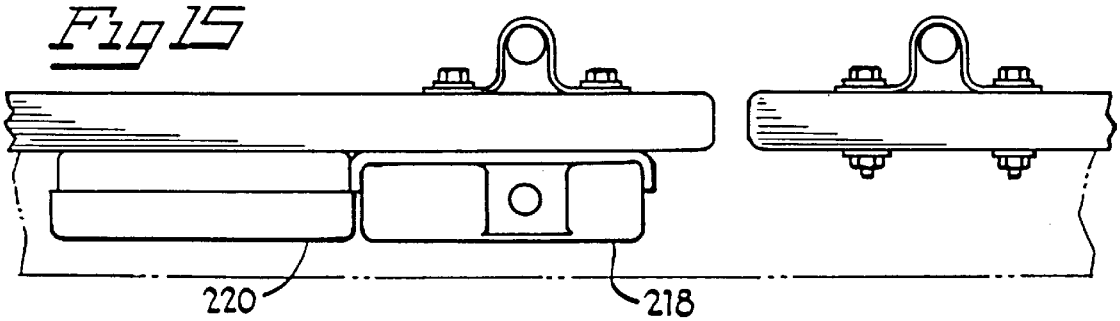

As best shown in FIG. 13, the lock assembly 158 has a back plate 180 adapted to fit and connect to a back, inside door of a container, for ease of installation and adjustment, if necessary. This structure can help in allowing for variations in door and frame geometries.

Figure 10:
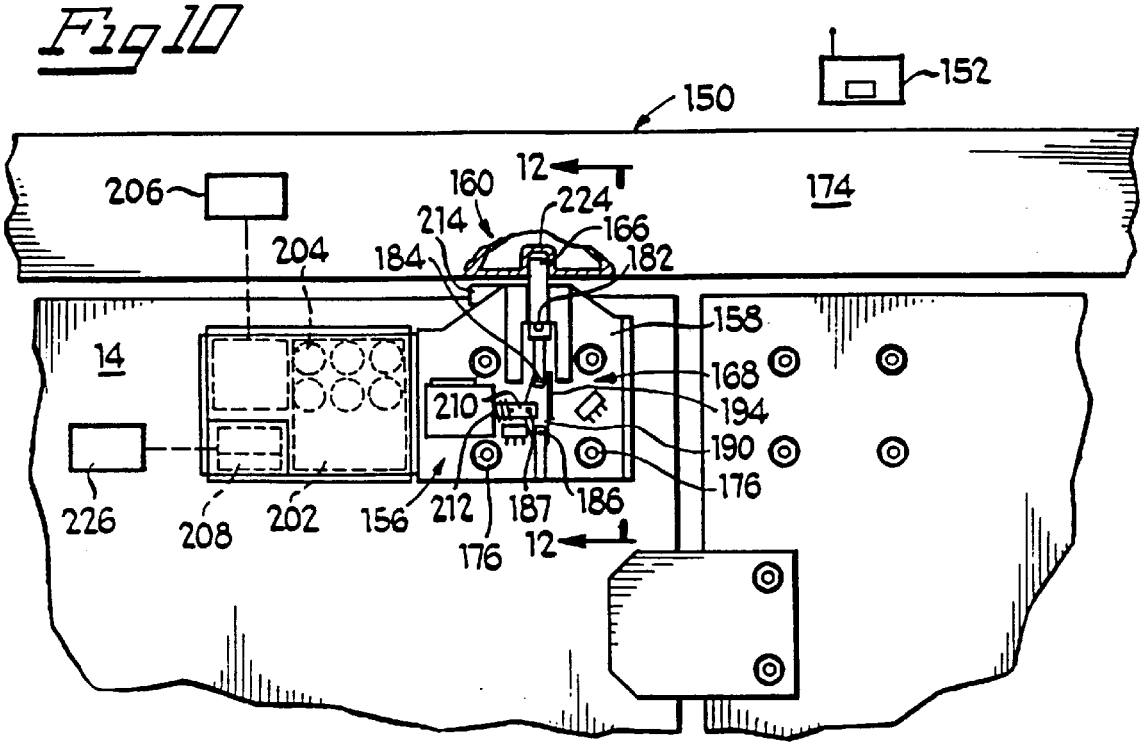
FIG. 10 is an inside view of part of an alternate embodiment of the security system, without a cover (to show the placement of some of the various components), in accordance with the present invention.

As illustrated in FIGS. 10 and 16, the linkage mechanism 168 includes a distal section 188 and a proximal section 190, the distal section 188 is coupled to the pin device 166 and the proximal section 190 is couplable with the electro-mechanical actuator 156, via a fourth pivot pin 188. This structure provides the advantages of converting minimal linear motion to angular motion required to magnify the linear movement of the pin device 166 from the locked 160 to the unlocked position 162 and vice versa. Advantageously, it also simulates a rigid link thus holding the pin device 166 in its locked position, for improved strength and integrity. Additionally, in the locked position 160, the system 150 is self locking and requires essentially no battery power, thus minimizing battery drain.

In one embodiment, the distal section 188 includes a stop tab 194. The stop tab 194 properly aligns the linkage mechanism 168 beyond center with respect to the proximal section 190 to simulate a rigid link securing the pin device 166 in it's locked position 160, in FIGS. 10 and 16.

The proximal and distal sections 190 and 188 are couplable with a middle pivot pin 184. The top pivot pin 182 allows rotation and transfer of motion through the distal section 188 to the pin device 166.

As shown in FIGS. 10 and 16, a bottom stationary pivot pin 186 pivotably connects the proximal section 190 to the lock assembly 158 back plate 180. The bottom stationary pivot pin 186 is significant in the conversion of linear to angular motion, and contributing to maintaining a simulated rigid link. This structure allows a minimal amount of displacement from the electro-mechanical actuator 156 to move and rotate the linkage mechanism 168, which in turn moves the pin device 166 to and from the locked and unlocked positions. During an attempted break-in (prying, striking, etc.), the linkage mechanism 168 is configured to maintain its integrity, by for example, transfering forces away from the solenoid 156.

As shown in FIG. 16, the back plate 180 can include one or more sensors 200 for sensing whether the pin device 166, is in the locked or unlocked position 160 or 162. In the event that the pin device 166 is not in an unlocked position after a given command from the remote transmitter 152, the sensor(s) 200 can provide a signal that will allow re-execution automatically after a predetermined time, for example. In addition, this structure can provide feedback in order to give positioning data as to internal location of the pin device 166.

In one embodiment, the security system 150 includes an electronic control 202 or interface structure, coupled to the receiver 154 and the electro-mechanical actuator 156. This structure interprets the transmitted information to suitably execute an open or close command, for example. Advantageously, this structure can receive information from the remote transmitter 152 without the necessity of an external power source other than the batteries or power supplies 208 shown in the figures. Also, this structure 202, like most of the other components of the security system 150, has a narrow width or profile so as to minimally intrude into the valuable cargo space of a container.

As shown in FIG. 10, the security system 150 further includes an electronic control or interface structure 202 coupled to the receiver 154 and the electro-mechanical actuator 156, capacitor(s) 204, an antenna 206 and a power supply 208. The capacitors 204 suitably build-up and store energy to rapidly release an electrical charge, to actuate the electro-mechanical actuator 156, to appropriately move a plunger 210. This provides an efficient use of the energy supplied by the power supply 208, preferably in the form of batteries. The antenna can vary widely depending on the application, and can be of a conventional or patch type, for example.

In a preferred embodiment, the antenna is placed internal to a container to keep it hidden and minimize the possibility of damage, and is appropriately coupled to the system 150, for reception of a signal. In another embodiment, the antenna could be external, if desired.

In a preferred embodiment, a sensor, such as but not limited to, a proximity sensor 214 can be utilized to allow the pin device 166 to be actuated only when a door 14 is in proximity to a metallic material, such as a header 174. Thus, this feature can help to minimize damage to the pin device 166, when closing the door with the pin device 166 in a locked or extended position 162. The sensor 214 is suitably connected to the other components of the security system 150, for example 154 and 156 and is preferably physically connected to and in proximity of the pin device 166, for accurate sensing.

In FIG. 16, the electro-mechanical actuator 156 includes a plunger 210, a snap ring 211 and a spring 212. The spring 212 provides an outward force to bias the plunger 210 to an extended position when the plunger 210 is released.

Figure 11:
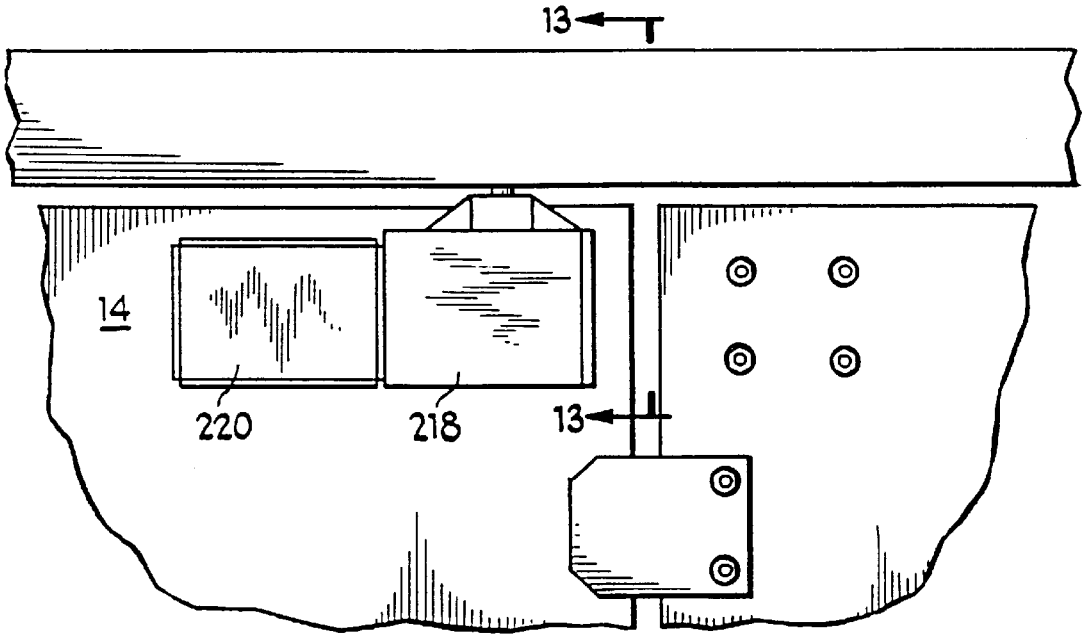
FIG. 11 is an inside view of part of the security system in FIG. 10, with a cover which protects many of the components, in accordance with the present invention.
Figure 12:
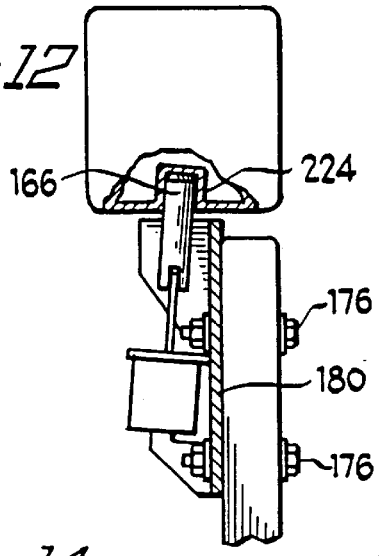
FIG. 12 is a side view taken along the lines 12—12 in FIG. 10 without a cover, of a portion of the security system of FIG. 10, in accordance with the present invention.

As best shown in FIG. 11, the lock assembly 158 can include a solenoid cover 218 and electronics cover 220 for protecting the system 150 components and linkage mechanism 168 from load shifts.

In use, the electro-mechanical actuator 156 is in a form of a solenoid, and can be suitably actuated, to convert electrical energy to magnetic energy, which in turn is convertable to a mechanical energy. Thus, this structure can generate a pulling action to provide the locked position 160 in FIG. 10. Continuing, the plunger 210 continues until it bottoms out internally against a permanent magnet within the actuator 156, thus, positioning the linkage to provide a simulated rigid link. Subsequently, when the actuator 156 is next actuated via the remote transmitter 152, the solenoid by use of the windings, releases the plunger 210 to allow it to move away from the magnet (to move to an extended, solenoid plunger 210 position) extending outwardly, defining an unlocked position as shown in FIG. 10 (right side).

As shown in FIG. 13, the pin device 166 can preferrably be in the form of a dead bolt at a predetermined angle with respect to a vertical axis, and is adapted to be coupled with a complementarily configured recepticle 224 of the header 174 of a container, to provide a self-engaging connection. In one embodiment, a port 224 is included in the door 12, to provide access to a electronic key 226 having an external probe means 228, for connection to system 150, to provide one or more of: external power to the system 150; a battery charger; open and close signals to the system 150; interrogate the system 150 and the like.

Thus, in one embodiment, a security system 150 for cargo loading doors is disclosed. The system can include: at least one of a remote transmitter 152 and electronic key 226 for transmitting a signal; a receiver 154 for receiving the signal from at least one of the remote transmitter 152 and the electronic key 226; an electro-mechanical actuator 156 coupled to the receiver 154 for moving a pin structure 166 between a locked position 160 and an unlocked position 162; and a lock assembly 158 adapted to hold the electro-mechanical actuator 156, and a linkage mechanism 168 coupling the electro-mechanical actuator 156 and the pin structure 166, for moving the pin structure 166 to and from the locked position to the unlocked position.

Various embodiments of a universal adapter for a security system are shown in FIGS. 17 through 29. In its simplest form, the adapter 300 can include: a back plate 302 having a left portion 304 and a right portion 306; and wing sections (also referred to as positioning adapter plates) 308 and 310 extending substantially outwardly from the left and right portions 304 and 306 of the back plate 302, the wing sections having an adjustment structure 312, adapted to adjustably receive a lock assembly 320 of a security system in a first position 322 proximate to the back plate 302 and a second position 324 away from the back plate 302, or in an alternate embodiment, a clamping structure for holding a locking structure with respect to an inside of a cargo loading door.

Figure 17:
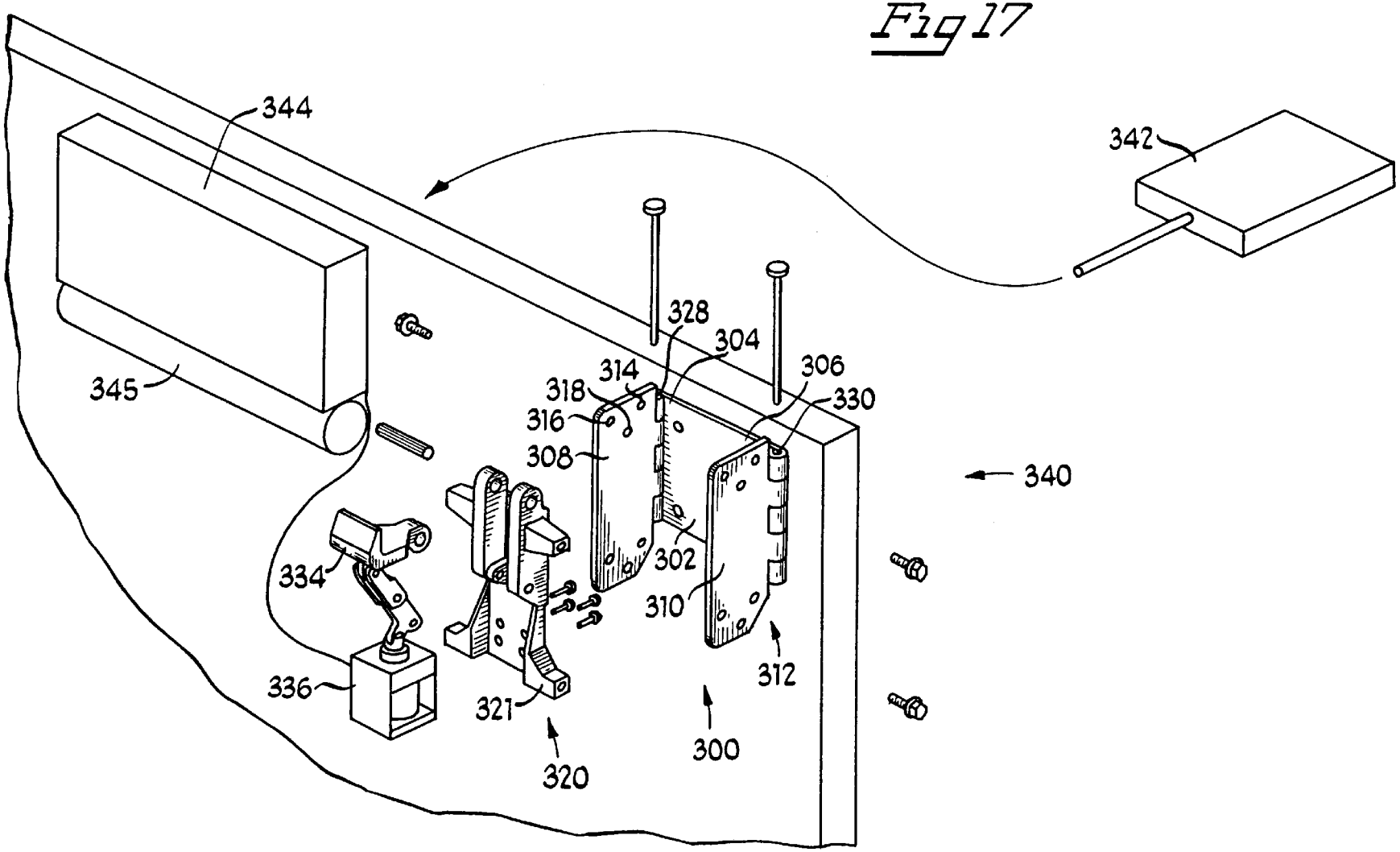
FIG. 17 is an isometric view of an embodiment of the security system, with an universal adapter (to show the placement of some of the various components) and a remote transmitter, in accordance with the present invention.

As illustrated in FIG. 17, in a preferred embodiment, the positioning adapter plates 308 and 310 have at least a first pair of vertically spaced ports 314 spaced in proximity to the back plate 302 and a second pair of vertically spaced ports 316 spaced away from the back plate 302, adapted to receive a lock assembly 320 of a security system in at least one of a first position 322 corresponding to being couplable with the first pair of ports 314 and a second position 324 corresponding to being couplable with the second pair of ports 316. The adapter provides a simple and cost effective design and configuration, to adjustably connect a locking structure with respect to a cargo loading door.

As shown in FIG. 17, the positioning adapter plates 308 and 310 can have a third pair of ports 318 or means for providing a third position 326 for receiveably coupling a lock assembly 320 of a security system with a cargo loading door, for example.

Figure 30:
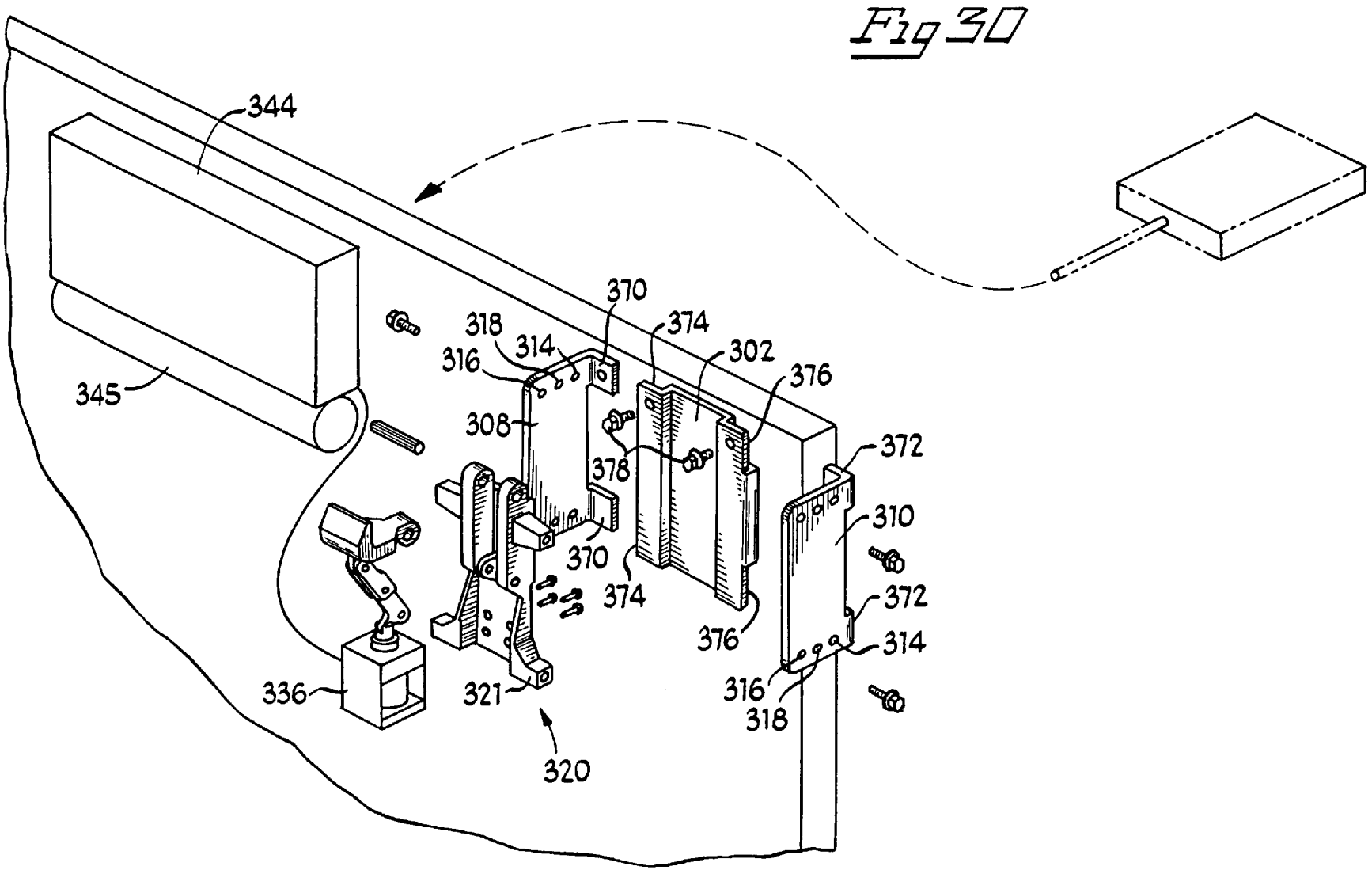
FIG. 30 is an isometric view of an alternate embodiment of the security system, with an universal adapter (to show the placement of some of the various components) and a remote transmitter, in accordance with the present invention.

In an alternate embodiment, slidably attachable positioning adapter plates 308 and 310, are shown in FIG. 30. More specifically, the positioning adapter plates 308 and 310 include inwardly extending flanges 370 and 372 adapted and complementarily configured to be received in receptacles 374 and 376, respectively, for simplified assembly, repair and installation, for example. Locking means, such as bolts 378 and the like securely couple the positioning adapter plates 308 and 310 with the back plate 302. Although shown in the drawings, the bottom flanges 370 and 372 and respective receptacles 374 and 376 are optional, in one embodiment.

Figure 18:
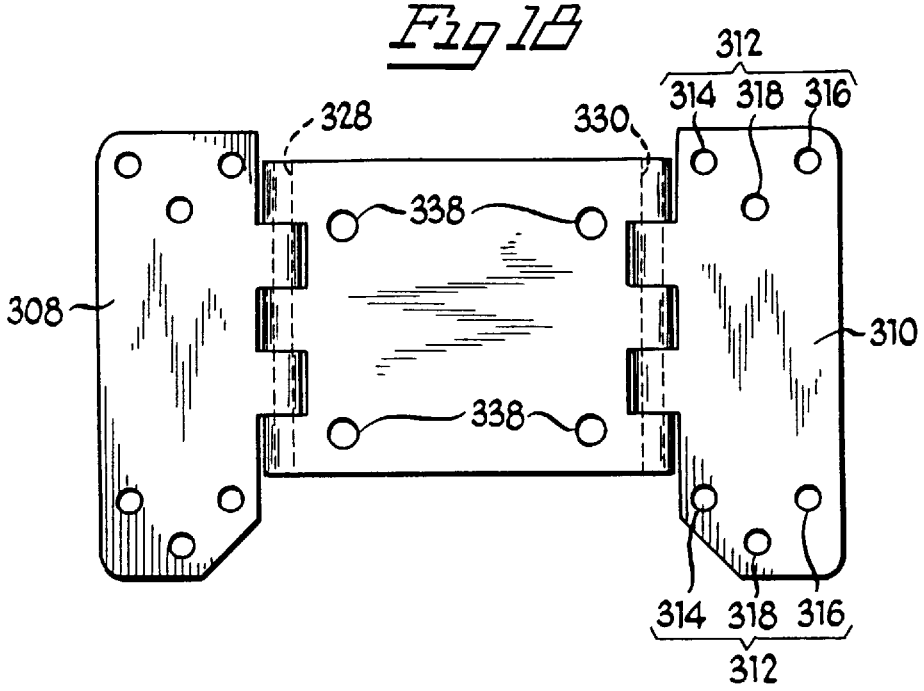
FIG. 18 is an elevated front view of the universal adapter in FIG. 17, in an open position, in accordance with the present invention.
Figure 19:
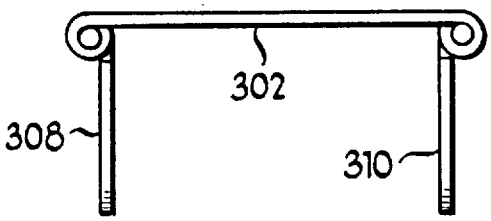
FIG. 19 is a top view of the universal adapter of FIG. 17, in a closed position, in accordance with the present invention.
Figure 20:
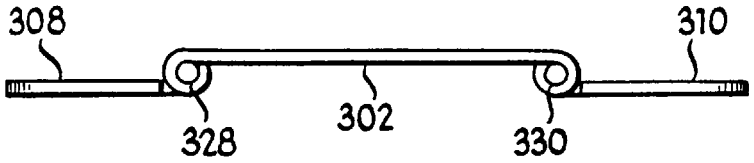
FIG. 20 is a top view of the universal adapter of FIG. 18, in an open position, in accordance with the present invention.
Figures 21, 22, 23, 24:
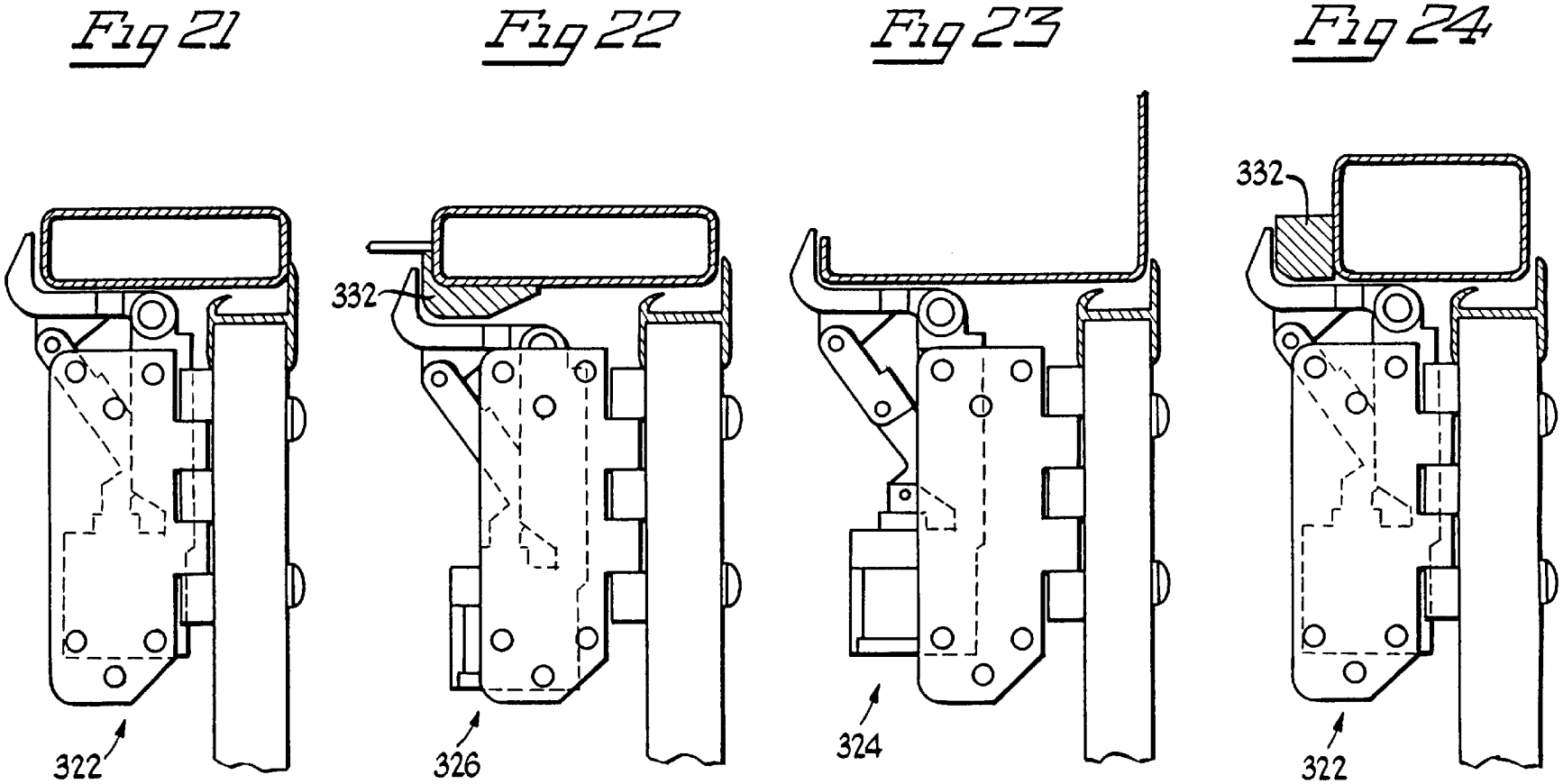
FIG. 21 is a partial view of the security system showing a side view of the universal adapter with a lock assembly with a latching device in a locked position, in accordance with the present invention.
FIG. 22 is a partial view of the security system showing a side view of the universal adapter with a lock assembly having a latching device in a locked position, the latching device is shown contacting a contour adapter, the lock assembly is shown connected to the adapter in a position proximate to a back plate of the adapter, the lock assembly is shown connected to the adapter in an intermediate position, in accordance with the present invention.
FIG. 23 is a partial view of the security system showing a side view of the universal adapter with a lock assembly with a latching device in a locked position, the lock assembly is shown connected to the adapter in a position away from a back plate of the adapter, in accordance with the present invention.
FIG. 24 is a partial view of the security system showing a side view of the universal adapter with a lock assembly having a latching device in a locked position, the latching device is shown contacting a contour adapter, the lock assembly is shown connected to the adapter in a position proximate to a back plate of the adapter, in accordance with the present invention.

Referring to FIGS. 18–20, the positioning adapter plates 308 and 310 can be hingably, slidably or fixably coupled to the back plate 302. In one embodiment, both positioning adapter plates 308 and 310 are hingably coupled via hinges 328 and 330, to the back plate 302, and the positioning adapter plates are substantially mirror images of each other. This construction provides a secure and adjustable connection and anchor for the lock assembly 320 with respect to a door. The hinge structure provides a simple structure for removing the pins 328 and 330, or removal by removing the bolts shown in the figures, when lock assembly is removed from the door. The wing sections 308 and 310 can be folded in a manner flush with the door (when the lock is not in use), thus being out of the way for loading and unloading. In an alternate embodiment, vertical positioning adapter plates are slide mountably coupled to the back plate, for ease of instalation.

In more detail, the positioning adapter plates 308 and 310 are adapted to at least partially receive a lock assembly 320 with a structure such as a pin or latch for example, for locking and unlocking cargo doors, as shown in FIGS. 21–24.

Thus, at least one of the back plate 302 and positioning adapter plates 308 and 310 is couplable with cargo doors of a trailer, domestic or ISO container, preferably trailer or domestic containers, since they are most adaptable and compatable with the adapter 300, as detailed herein. As should be understood by those skilled in the art, the instant invention can be used with structure other than the doors detailed herein, in connection with providing a security system and a secure locking structure.

Referring to FIGS. 21–24, the adapter can further include a contour adapter 322 being complimentarily configured to interconnect with at least part of a latch structure of a lock assembly 320, defining a self-locking mechanism. As shown in the figures, the positioning adapter plates 308 and 310 are adapted to at least partially receive a lock assembly 320 with a latch structure 334 for locking and unlocking cargo doors with an electro-mechanical actuator 336, preferably a solenoid. The solenoid is operable to move the latch 334 or pin (dead bolt structure) to and from a locked position to an unlocked position (as shown in FIGS. 25 and 26).

In one embodiment, a security system 340 with a universal adapter 300 is disclosed, such as shown in FIG. 17. It can include: a remote transmitter 342 for transmitting a signal; a receiver 344 for receiving the signal from the remote transmitter; an electro-mechanical actuator 336 coupled to the receiver 344 for moving a locking structure between a locked position and an unlocked position; the locking structure 320 adapted to receive the electro-mechanical actuator 336, and the electro-mechanical actuator 336 is shown couplable by a linkage mechanism for moving the locking structure to and from the locked position to the unlocked position; and an adapter 300 (in FIG. 17 for trailer applications) or mounting bracket 368 preferably with adapter 350, for ISO container applications (in FIGS. 25–29), for coupling the locking structure with a door, preferably a cargo door, as detailed herein.

In one embodiment, the lock assembly 320 is adapted to being connected to an inside of a door, such as a cargo loading door with the adapter 300 or preferably a mounting bracket 368 . The locking structure 320 and mounting bracket 368 are adapted to being connected with a header of an ISO container, domestic container or semi-trailer, defining a locked position in FIG. 25, and disconnected from the header when the locking structure is in the unlocked position in FIG. 26.

For improved security, the lock assembly 320 can include at least one or more connecting devices 346, such as four bolts, attached in and through an inside cargo loading door , as shown in FIG. 25. In addition, positioners 348, such as positioner bolts, touch and contact an inside cargo loading door, for improved positioning, to insure a secure coupling.

As detailed herein, the system 340 can include an electronic control, operatively coupled to the receiver 344, which can include a mail pouch 345, as shown in FIG. 17, and the electro-mechanical actuator 336, including a trigger circuit, capacitors and power semiconductors, for wireless actuation of the locking structure. A thermal insulative quilt can be used in connection with the receiver 344 and other structure, as shown in FIGS. 31–34, for thermal and physical protection of the batteries and associated components, from exposure to the elements (rain, snow, dust, dirt, etc.) and severe temperature variations.

In one embodiment, the adapter 300 can comprise: a back plate 302 having a left portion and a right portion; and positioning adapter plates 308 and 310 extending substantially outwardly from the left and right portions of the back plate 302, the positioning adapter plates 308 and 310 having means for adjustably receiving a lock assembly of a security system in at least one of a first position proximate to the back plate and a second position away from the back plate, as illustrated in FIGS. 21–24.

In an alternative embodiment, as shown in FIGS. 25–29, the mounting bracket 368 with adapter 350, comprises clamping device 351 for substantially securing the locking structure 352 with respect to an inside of a cargo loading door, preferably an ISO container door. The adapter 350 can be in the form of a clamping structure for substantially securing a locking structure with respect to an inside of a cargo loading door. The clamping structure 351 can include a plurality of substantially mirror imaged grip plates 354 and 356, each including a proximal section 358 and distal section 360 with teeth structures 362, for securely gripping and clamping onto a surface, the proximal section 358 is adjustably couplable by various means, such as with a lip 366 and a bolt 364, for facilitating, secure coupling of a lock structure with respect to a door. In one embodiment, the mounting bracket 368 and adapter 350 are an integral (substantially single) structure, for simplicity of construction and minimal parts In this embodiment, the locking structure has it's own integrated back plate 368. The locking structure in this embodiment is particularly configured and designed to mate and be coupled to a door of an ISO container. As shown in FIGS. 25 and 26, the clamping device 351 assures that a top portion of the locking structure 352 and integrated mounting bracket 368 is substantially held in place. Likewise, the bottom portion is held snugly in place with the positioner bolt 348. Thus, this structure is configured to securely hold a locking structure 352 in place with respect to a door, without the necessity of drilling and placing bolts, etc. through a door. Optionally, the mounting bracket 368 can also be bolted to the door or otherwise suitably connected to a door.

Figure 31:
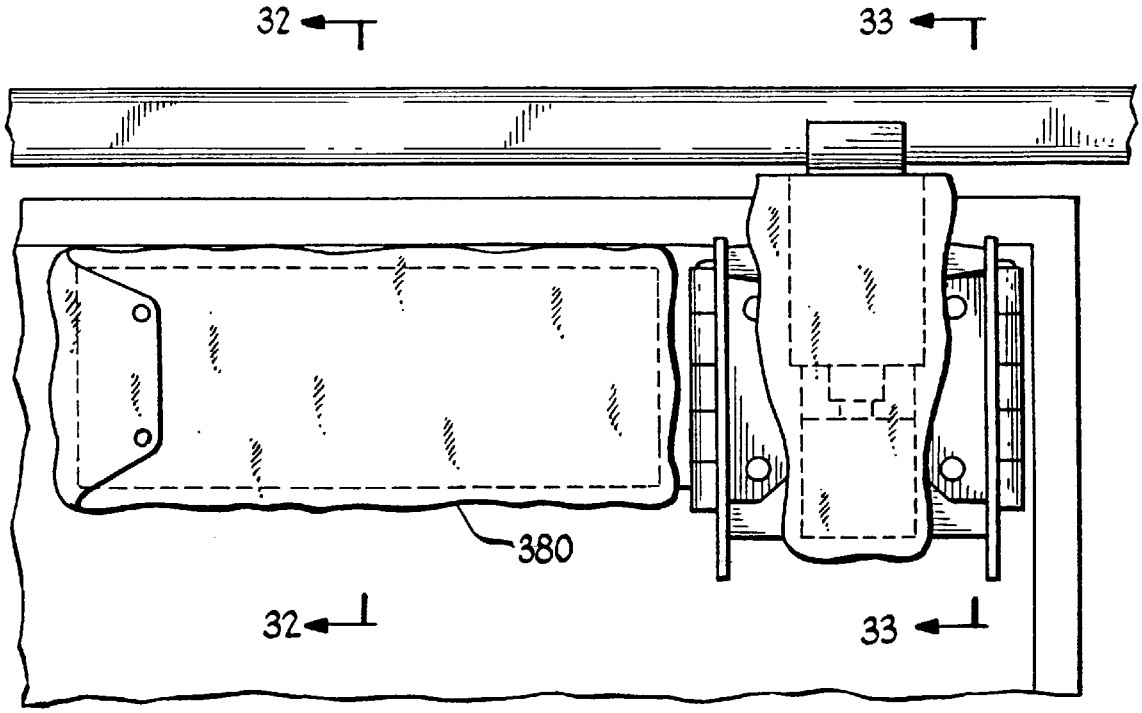
FIG. 31 is an elevated front view of the universal adapter in FIG. 17, with an insulative protection layer, in accordance with the present invention.
Figure 32:
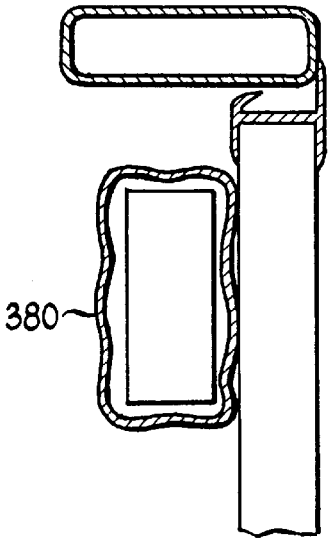
FIG. 32 is a side sectional view along lines 32—32 of the universal adapter of FIG. 30, in accordance with the present invention.
Figure 33:
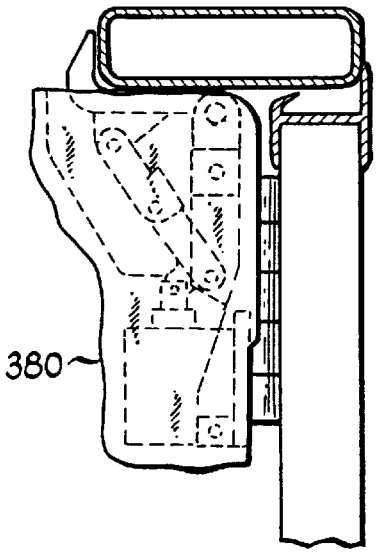
FIG. 33 is a side sectional view along lines 33—33 of the universal adapter of FIG. 30, in accordance with the present invention.

In FIGS. 31–33, a preferred insullating quilt layer 380 is shown substantially enclosing the components of the invention, for thermal and physical protection.

Although various embodiments of the invention have been shown and described, it should be understood that various modifications and substitutions, as well as rearrangements and combinations of the preceding embodiments, can be made by those skilled in the art.

What is claimed is:

1. A universal adapter for a security system, comprising:

a substantially planar back plate having a left portion and a right portion; and positioning adapter plates coupled to and extending substantially outwardly from the left and right portions of the substantially planar back plate, the positioning adapter plates having at least a first pair of ports spaced in proximity to the substantially planar back plate and a second pair of ports spaced away from the substantially planar back plate, the substantially planar back plate and positioning adapter plates being configured to receive a substantially rectangular lock assembly of a security system in at least one of a first position corresponding to being couplable with the first pair of ports and being spaced in proximity to the substantially planar back plate and a second position corresponding to being couplable with the second pair of ports and being spaced away from the back plate, the substantially planar back plate and substantially rectangular lock assembly being positioned substantially parallel to each other, the positioning adapter plates are securely coupled to the substantially planar back plate, the back plate and positioning adapter plates defining a substantially U-shape as viewed from a top view having a substantially shallow receptacle for receiving the substantially rectangular lock assembly.

2. The universal adapter of claim 1, wherein the positioning adapter plates have a third pair of ports for providing a third position for receiveably coupling the substantially rectangular lock assembly therewith.

3. The universal adapter of claim 1, wherein the positioning adapter plates are securely coupled to the substantially planar back plate, with the positioning adapter plates defining the vertical components of the U-shape and the substantially planar back plate defining the horizontal component thereof.

4. The universal adapter of claim 1, wherein the positioning adapter plates are substantially mirror images of each other.

5. The universal adapter of claim 1, wherein the positioning adapter plates are adapted to at least partially receive the substantially rectangular lock assembly, the lock assembly includes structure for locking and unlocking cargo doors.

6. The universal adapter of claim 1, wherein at least one of the back plate and positioning adapter plates is couplable with cargo doors of a trailer, domestic or ISO container.

7. The universal adapter of claim 1, further comprising a contour adapter being complimentarily configured to interconnect with at least part of a latch structure of a lock assembly.

8. The universal adapter of claim 1, wherein the positioning adapter plates are adapted to at least partially receive a lock assembly, the lock assembly includes a latch and pin structure for locking and unlocking cargo doors with an actuator.

9. A universal adapter in combination with a security system, comprising:

a substantially planar back plate having a left portion and a right portion; and positioning adapter plates being coupled to and extending substantially outwardly from the left and right portions of the substantially planar back plate, the positioning adapter plates having at least a first pair of substantially aligned ports spaced in proximity to the substantially planar back plate, a second pair of substantially vertically aligned ports spaced away from the substantially planar back plate and a third pair of substantially vertically aligned ports positioned substantially between the first and the second substantially aligned ports, adapted to receive a lock assembly of a security system in at least one of a first position corresponding to being couplable with the first pair of substantially vertically aligned ports, a second position corresponding to being couplable with the second pair of substantially aligned ports and a third position corresponding to being couplable with the third pair of substantially aligned ports, the positioning adapter plates are configured to at least partially receive the lock assembly, the lock assembly includes at least one of a latch and a pin structure for locking and unlocking cargo doors with an actuator operable to move the at least one latch and pin structure to and from a locked position to an unlocked position, the substantially planar back plate and lock assembly being positioned substantially parallel to each other.

10. The universal adapter of claim 9, wherein at least one of the positioning adapter plates is hingably coupled to the substantially planar back plate and the positioning adapter plates are substantially mirror images of each other.

11. The universal adapter of claim 9, wherein at least one of the substantially planar back plate and positioning adapter plates is couplable with cargo doors of a trailer, domestic container, an insulative material substantially enclosing a receiver.

12. The universal adapter of claim 9, wherein the positioning adapter plates are adapted to at least partially receive a lock assembly, the lock assembly includes a latch structure for locking and unlocking cargo doors with an electromechanical actuator operable to move the latch to and from a locked position to an unlocked position.

13. A security system in combination with a universal adapter, comprising:

an actuator for moving a locking structure between a locked position and an unlocked position;

a lock assembly adapted to receive the actuator, the locking structure and the actuator are couplable by a linkage mechanism for moving the locking structure to and from the locked position to the unlocked position; and an adapter for adjustably, coupling the lock assembly with a cargo loading door, wherein the adapter comprises: a substantially planar back plate having a left portion and a right portion; and positioning adapter plates being coupled to and extending substantially outwardly from the left and right portions of the substantially planar back plate, the positioning adapter plates having means for adjustably receiving a substantially rectangular lock assembly of a security system in at least one of a first position proximate to the substantially planar back plate and a second position away from the substantially planar back plate, the substantially planar back plate and substantially rectangular lock assembly being positioned substantially parallel to each other.

14. The security system of claim 13, wherein the substantially rectangular lock assembly is adapted to being connected to an inside of a cargo loading door with the adapter, and further includes a layer of insulative material.

15. The security system of claim 13, wherein the substantially rectangular lock assembly is connected with a header of an ISO container, domestic container or semi-trailer, defining a locked position and disconnected from the header when the locking structure is in the unlocked position.

16. The security system of claim 13, wherein the substantially rectangular lock assembly includes at least one of connecting devices attached in and through an inside cargo loading door and connecting devices touching an inside cargo loading door.

17. The security system of claim 13, wherein the substantially rectangular lock assembly includes an electronic control, operatively coupled to the receiver and the electromechanical actuator, including a trigger circuit, capacitors and power semiconductors, for actuating the locking structure.

18. The security system of claim 13, wherein the adapter comprises clamping means for substantially securing the locking structure with respect to an inside of a cargo loading door.

19. The security system of claim 13, wherein the adapter comprises a clamping structure for substantially securing the locking structure with respect to an inside of a cargo loading door, which includes a plurality of mirror imaged grip plates, each including a proximal section and distal section with teeth structures for securely gripping and clamping onto a surface, the proximal sections are adjustably coupled together and are adapted to provide a secure coupling of a lock structure with respect to a door.

* * * * *